United States Patent [19]

Flanagan

[11] 4,160,526

[45] Jul. 10, 1979

[54] LIQUID FUEL ATOMIZING NOZZLE

[75] Inventor: Paul Flanagan, Princeton, N.J.

[73] Assignee: Flynn Burner Corporation, New Rochelle, N.Y.

[21] Appl. No.: 839,769

[22] Filed: Oct. 6, 1977

Related U.S. Application Data

[60] Division of Ser. No. 780,852, Mar. 24, 1977, Pat. No. 4,130,388, which is a continuation of Ser. No. 723,542, Sep. 15, 1976, abandoned.

[51] Int. Cl.[2] ..... B05B 7/06

[52] U.S. Cl. ..... 239/427; 239/431

[58] Field of Search ..... 239/428, 427, 429, 430, 239/431, 419.3, 406

[56] References Cited

U.S. PATENT DOCUMENTS

| | | | |
|---|---|---|---|
| 500,005 | 6/1893 | Jones | 239/417.3 X |
| 2,682,302 | 6/1954 | Cote | 239/406 |
| 3,310,240 | 3/1967 | Grundman | 239/406 X |

*Primary Examiner*—Robert B. Reeves
*Assistant Examiner*—Michael J. Forman
*Attorney, Agent, or Firm*—Michael Ebert

[57] ABSTRACT

A liquid fuel atomizer nozzle having a liquid fuel input and an air input, the nozzle including an internal mixing chamber in which the incoming liquid fuel to be atomized is subjected to high velocity air streams both within the central core of the liquid and about its periphery to effect thorough atomization of the liquid even at low atomizing air flow rates and pressures.

6 Claims, 11 Drawing Figures

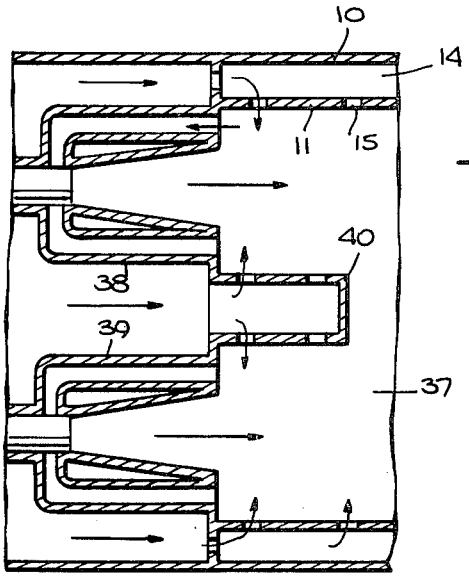
Fig. 4.
Fig. 5.
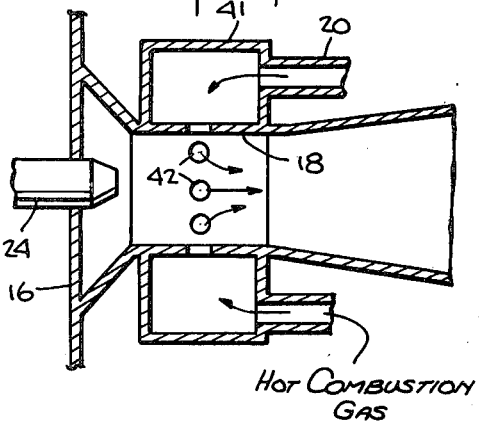
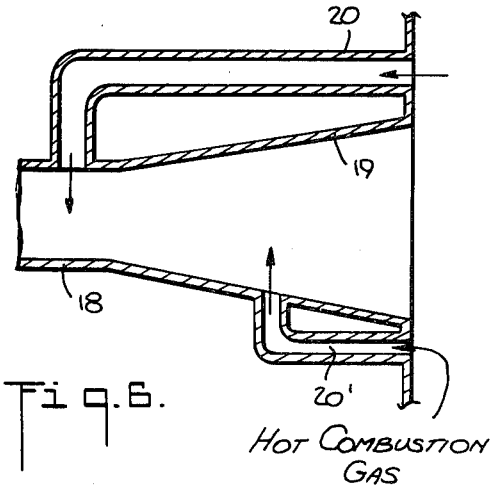
Fig. 6.
Fig. 7.
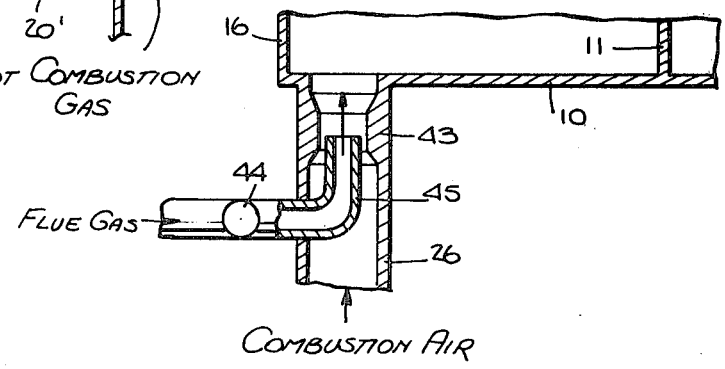

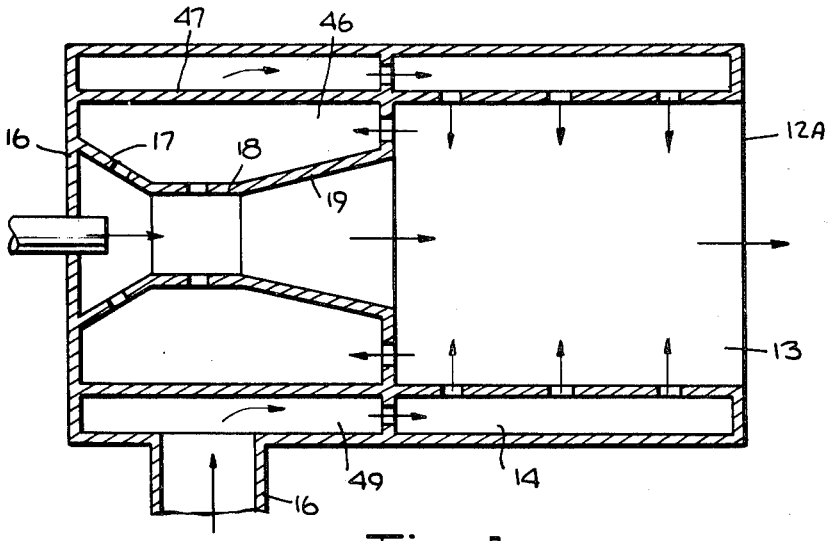
Fig. 8.
Fig. 9.
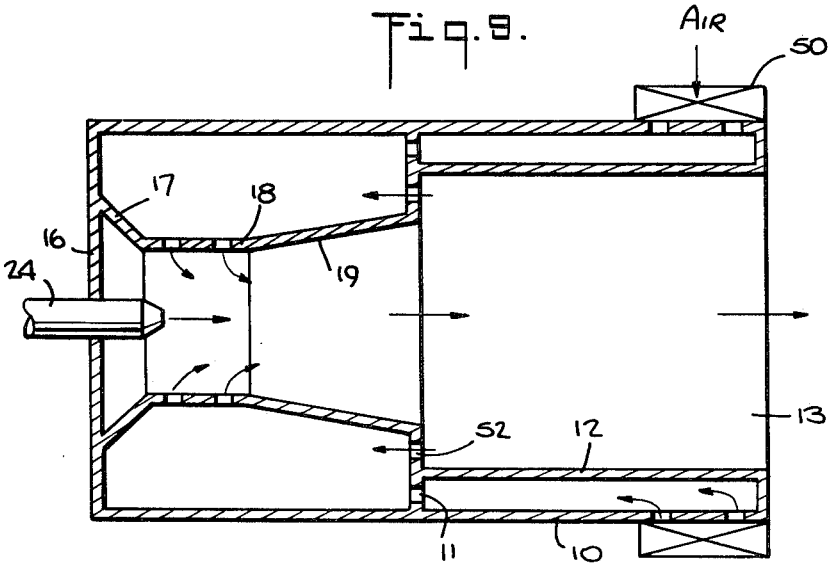

LIQUID FUEL
AIR
LIQUID FUEL
AIR

LIQUID FUEL ATOMIZING NOZZLE

RELATED APPLICATION

This application is a division of my copending application Ser. No. 780,852, filed Mar. 24, 1977, now U.S. Pat. No. 4,130,388, issued Dec. 19, 1978, entitled "Non-Contaminating Fuel Burner" which, in turn, is a continuation of a parent application Ser. No. 723,542, filed Sept. 15, 1976 (now abandoned).

BACKGROUND OF INVENTION

This invention relates generally to fuel burners, and more particularly to an apparatus which efficiently burns fuel to produce a stable, non-contaminating blue flame over a broad operating range, the fuel being a liquid hydrocarbon to which a gaseous hydrocarbon may be added.

Conventional forms of fuel burners, even when carefully adjusted, often operate inefficiently and produce yellow or orange flames characterized by incomplete combustion. This gives rise to soot deposits in the flue and to the discharge into the atmosphere of particulates. Hence such burners not only fail to operate economically, but they act to contaminate the atmosphere. The concern of the present invention is with burners which are adapted to effect full combustion of fuel supplied thereto and to produce a stable, non-contaminating blue flame.

Liquid fuel burners are known in which gasification of the liquid fuel is effected by recirculating a portion of the hot combustion gas into admixture with the fuel in order to promote full combustion. Typical of commercial blue-flame, liquid fuel burners which make use of a gasification system is the THERMAL HV (high velocity) burner manufactured by the Thermal Research and Engineering Corp. of Conshohocken, Pa., a division of Trane Thermal Company, under U.S. Pat. Nos. Re 24,682; 2,839,128 and 3,042,105, among others.

In a THERMAL HV burner, liquid fuel is injected into the inlet of a flow passage leading to a combustion zone, combustion air being fed into the same passage. The mixture of fuel and air is ignited in the combustion zone, and a portion of the resultant hot combustion products are drawn back into the inlet of the flow passage through a feedback passage. This recirculated hot gas serves to promote vaporization of the fuel-air mixture before it is ignited to ensure full combustion thereof.

In the THERMAL HV burner, the recirculation of the hot combustion gas is induced by forcing all of the incoming, relatively cool combustion air into the flow passage through a throat section of reduced diameter, thereby creating a low-pressure Venturi effect serving to suck the hot gas from the feedback passage into the inlet of the flow passage to prevaporize the liquid fuel. The pressure differential or Venturi effect required to draw in the hot combustion gas depends primarily on the mass velocity or momentum of the incoming combustion air passing through the throat section; the greater this momentum, the stronger the suction force for drawing in the hot gas.

It is well known that to achieve proper conversion efficiency, one must maintain close to a stoichiometric air/fuel ratio in the burning zone over the full range of operating conditions from high to low. Every chemical reaction has its characteristic properties. For example, when methane unites with oxygen in complete combustion, 16 grams of methane require 64 grams of oxygen. If, therefore, at a given operating setting of the burner, where a given amount of liquid fuel is being fed therein, a proper proportion of air must also be introduced to obtain a stoichiometric ratio producing full combustion and a blue flame.

If one thereafter turns down the burner to reduce the volume of liquid fuel being admitted therein, one must at the same time lower the flow rate of incoming air to maintain the proper ratio therebetween. As a consequence, in a blue flame burner of the THERMAL HV type and in other burners operating along similar principles, the pressure differential available to promote recirculation of hot gas falls off as the burner is turned down, the fall-off curve being steep when the burner has a wide operating range.

These known burner arrangements therefore provide proper hot gas recirculation and function at their optimum efficiency only when the burner is turned almost all the way up; for as one turns down the burner, there is a concomitant loss of suction force and weakened recirculation of the hot gases necessary to effect prevaporization of the liquid fuel. The liquid fuel, instead of being pre-vaporized before entry into the combustion chamber, enters therein in the form of atomized droplets. As a result, combustion is incomplete and objectionable contaminants are generated.

An important factor which comes into play in determining the conversion efficiency of a liquid fuel burner is atomization of the fuel; for the finer the atomization, the more effective is the conversion process. Generally, atomization is carried out by steam or pressurized air. As noted in the *Combustion Handbook*, published by the North American Manufacturing Co. of Cleveland, Ohio, it is customary to classify atomizing streams as high pressure streams (above 5 psig) and as low pressure streams, typically in the order of 2 psig.

A further classification is based on the nature of the mixing process; that is, whether the fuel and atomizing streams are internally or externally mixed. Internal mixing usually involves high pressure streams, while external mixing is of the low pressure variety.

In an internal mixing fuel atomizer, the atomizing air stream and the liquid fuel are introduced into a mixing chamber where vigorous agitation takes place at relatively high velocities to create a finely atomized mixture. In an external mixing system, the liquid fuel to be atomized is discharged from a nozzle and is then subjected to the atomizing stream.

In an atomizer, it is generally desirable that the mass flow ratio of atomizing air-to-liquid fuel (i.e., the nozzle air/fuel ratio) be minimized. Moreover, since a source of compressed air or other atomizing medium is usually included in a packaged atomizer system, in order to eliminate the need for large atomizing power drive trains, the pressure requirements of the atomizing stream should be kept to a minimal level.

The problem heretofore encountered in producing a fuel-atomizing system is that while one can optimize the nozzle air/fuel ratio and minimize the power requirements under fixed operating conditions, it is difficult to attain satisfactory atomization over wide liquid flow turn-down ranges with a minimum of absorbed power at a low air-to-liquid mass flow rate at the maximum capacity.

SUMMARY OF INVENTION

In view of the foregoing, it is the main object of this invention to provide a fuel burner adapted to produce a stable, non-contaminating blue flame throughout a broad operating range.

More particularly, it is an object of this invention to provide a highly efficient fuel burner in which a portion of the hot combustion gas produced in the combustion zone of the burner is recirculated to pre-vaporize the atomized-liquid fuel being fed into the combustion zone, an adequate level of hot gas recirculation being maintained throughout the broad operating range of the burner, even when under low fire conditions the incoming flow of combustion air is at a low level.

Still another object of the invention is to provide a compact blue-flame burner of simple design which operates efficiently and reliably throughout its full operating range and which may be mass-produced at low cost.

A self-sufficient contaminant-free burner in accordance with the invention has many industrial applications and may be fired directly into ovens, kilns, furnaces and other heating equipment without designing a combustion zone into the equipment, thereby making possible significant reductions in equipment size. Since combustion is virtually complete within the combustion zone of the burner itself, the thermal expansion of the combustion gases affords a high exit velocity. This high exit velocity coupled with near stoichiometric flame temperatures assures high coefficients of convective heat transfer.

Also an object of the invention is to provide an improved liquid fuel atomizer in which the liquid fuel to be atomized is subjected in an internal mixing chamber to high velocity air streams both within the central core of the liquid and about its periphery to effect thorough atomization of the liquid even at low atomizing air flow rates and pressures.

Briefly stated, these objects are attained in a blue-flame burner in accordance with the invention in which an atomized liquid fuel is projected by an atomizer nozzle wherein liquid fuel is intermixed with atomizing air, through a Venturi into a combustion zone. Combustion air is directly fed into the combustion zone, a portion of the hot combustion gas being fed through a feedback passage into the throat section of the Venturi and being drawn therein by the ejector effect of the atomized liquid projected therein to pre-vaporize the atomized liquid and thereby insure full combustion thereof in the combustion zone. The recirculation of hot combustion gas is effective throughout a broad turndown range even at low-fire conditions in which the incoming flow of combustion air is at a low level.

OUTLINE OF DRAWINGS

For a better understanding of the invention as well as other objects and further features thereof, reference is made to the following detailed description to be read in conjunction with the accompanying drawings, wherein:

FIG. 1 schematically shows in longitudinal section a preferred basic embodiment of a blue-flame burner in accordance with the invention;

FIG. 4 is a third modification of the basic burner;

FIG. 5 is a fourth modification of the basic burner;

FIG. 6 is a fifth modification of the basic burner;

FIG. 7 is a sixth modification of the basic burner;

FIG. 8 is a seventh modification of the basic burner;

FIG. 9 is an eighth modification of the basic burner;

Figures 10, 11:
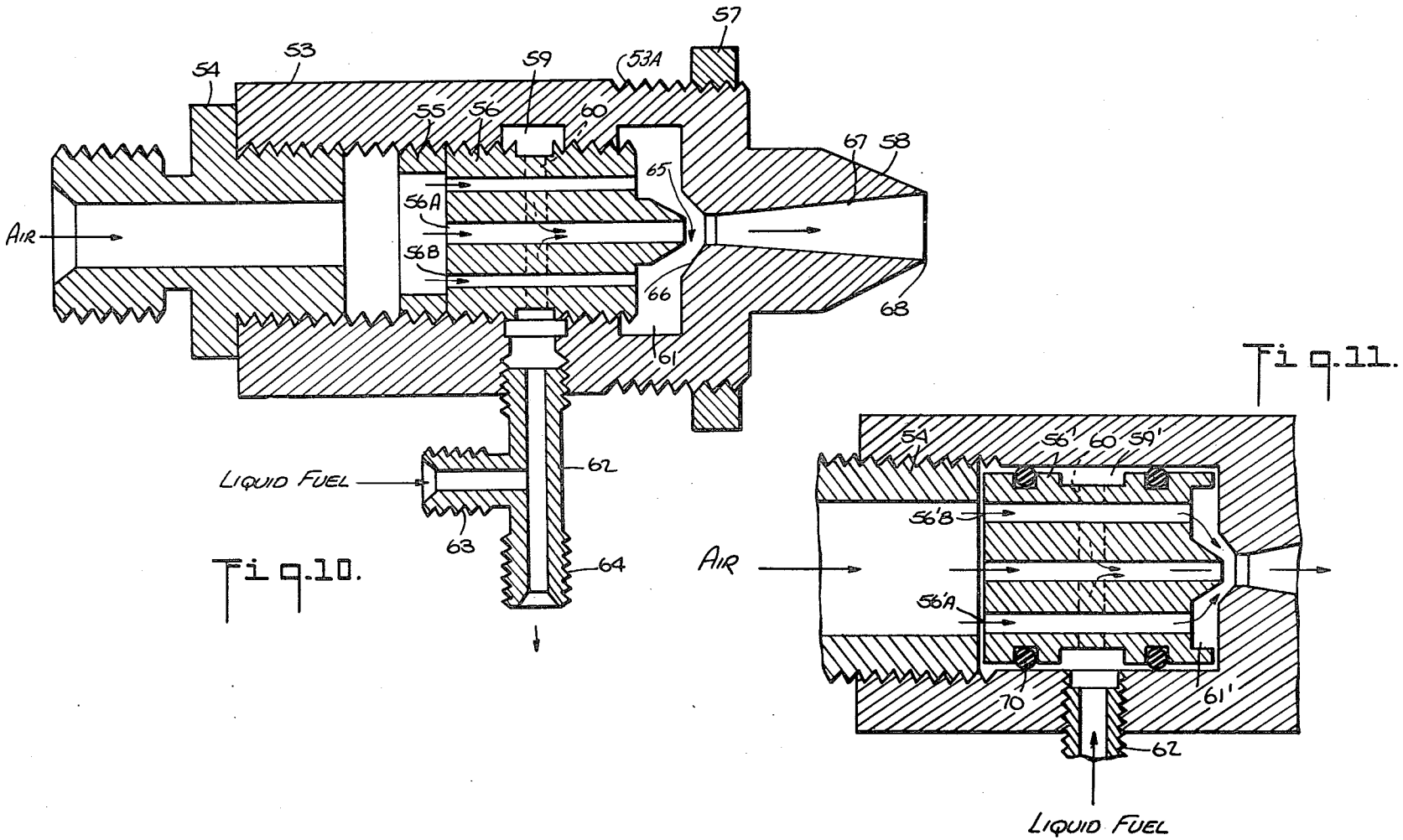

FIG. 10 schematically shows in longitudinal section a preferred embodiment of a liquid fuel atomizer in accordance with the invention; and FIG. 11 is a simplified form of the liquid fuel atomizer.

DESCRIPTION OF INVENTION

The Basic Burner Structure

Figure 1:
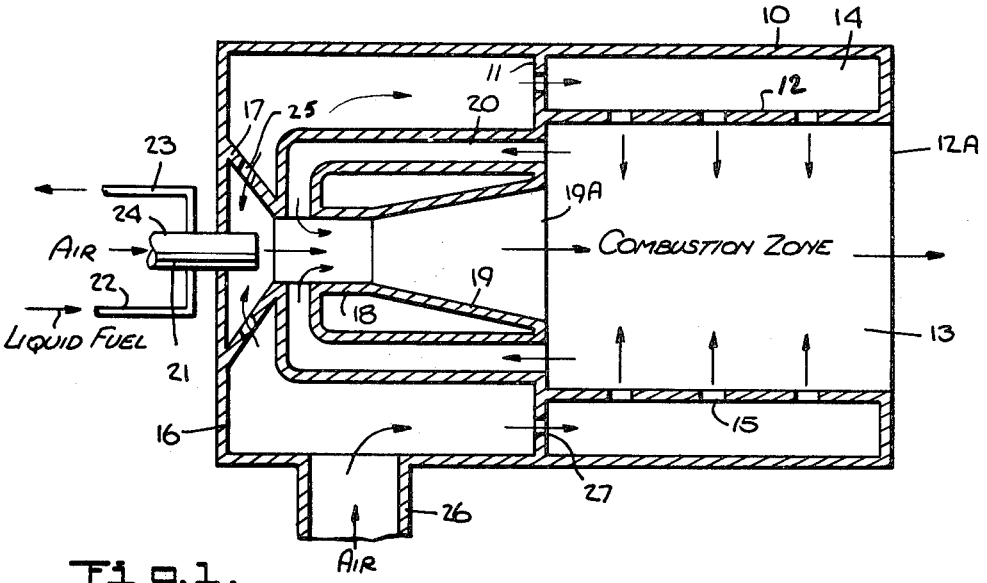

Referring now to FIG. 1, there is schematically shown a blue-flame liquid fuel burner in accordance with the invention making use of a gasification system in which a portion of the hot combustion gas is recirculated to ensure full combustion throughout a wide operating range.

The burner structure includes a cylindrical outer casing 10 divided by a partition 11 into a forward or upstream section and a rear or downstream section. Concentrically mounted within the forward section of outer casing 10 is an inner casing 12 which defines therein a cylindrical combustion zone 13. The annular space between inner and outer casings 10 and 12 functions as a combustion air-admission chamber 14. Inner casing 12 is provided for this purpose with a circumferential array of openings 15 which provide combustion air jets at right angles to the direction of the incoming pre-vaporized liquid fuel, as indicated by the arrows. In practice, the air jets may be inclined somewhat to promote recirculation.

Outer casing 10 is provided with a rear wall 16 to enclose the rear section of the burner. Supported therein between rear wall 16 and partition 11 is a Venturi structure constituted by a converging inlet section 17, a constricted throat section 18 and a diverging diffuser section 19, the latter opening into combustion zone 13. A portion of the hot combustion gas generated with combustion zone 13 is fed back into throat section 18 of the Venturi by feedback ducts 20.

Supported centrally on rear wall 16 of outer casing 10 is an atomizer nozzle 21 to which liquid fuel is supplied by an input line 22. The unused portion of the fuel is returned to the fuel source via a spill line 23. Also fed to nozzle 21 through an input port 24 is an atomizing air stream. The conical inlet section 17 of the Venturi structure may be provided with openings 25 to admit a small amount of the combustion air into the inlet section to intermingle with the air-atomized liquid injected into the Venturi.

Extending laterally from the rear section of outer casing 10 is an input pipe 26 which feeds combustion air into the region surrounding the Venturi, the combustion air being forced into air-admission chamber 14 through ports 27 in partition 11. The flow path of the combustion air from input pipe 26 is indicated by arrows.

In operation, air-atomized liquid fuel injected by atomizer nozzle 21 into the converging inlet section 17 of the Venturi structure is projected at high velocity through the constricted throat section 21. The air-atomized fuel is then diffused by diffusion section 19 of the Venturi before it enters combustion zone 13 where it is ignited. A portion of the resultant combustion gas from the combustion zone is fed back to throat section 21 of the Venturi through ducts 20 for recirculation.

In throat section 18 of the Venturi, the air-atomized liquid fuel issuing from nozzle 21 creates an ejector effect, causing a pressure drop and inducing entrainment and recirculation of the hot combustion gas taken from the output of feedback ducts 20. In this way, pre-vaporization of the air-atomized liquid fuel takes place before this mixture enters the combustion zone at exit plane 19A of diffuser section 19.

Thus throat section 18 of the Venturi, which entrains the recirculating hot combustion gas, constitutes a mixing zone to pre-vaporize the atomized fuel, the rate of entrainment in this zone being controlled by the mass flow rate of nozzle 24, its axial position, the nozzle-to-Venturi throat area ratio and the available diffuser pressure differential as well as the dimensions of the recirculation passages. Upon completion of the combustion process, the combustion gas is discharged from the burner at the output plane 12A of inner casing 12.

The burner structure illustrated in FIG. 1 affords highly efficient combustion over a wide turn-down range to ensure blue flame, contaminant-free operation under all operating conditions, in that adequate recirculation of the hot combustion gas to effect pre-vaporization of the atomized fuel is maintained throughout the operating range.

In known types of burners in which the combustion gas is recirculated, the combustion air stream is directed upstream toward the combustion zone through the Venturi; whereas in the present invention, this air is directly fed into the combustion zone, and the ejector action is derived from the air-atomized fuel projecting from the jet nozzle into the Venturi.

Consequently, even though the combustion gas pressure produced by the ignited fuel in the combustion zone has both upstream and downstream components creating momentum forces, in prior burner arrangements, the downstream component is more or less counterbalanced by the opposing force of the upstream-projected combustion air stream. But in the present arrangement, no such opposition is offered, and a substantial back pressure is developed which propels a portion of the hot combustion gas into feedback ducts 16. This back pressure is less substantial at the low end of the operating range when the rate of combustion air fed into the combustion zone is at its lowest level, but the ejector effects of the nozzle at the low end of the range is sufficient to provide adequate feedback of the hot combustion products.

Also, in the present arrangement, at low fire conditions in the operating range, the air-to-fuel mass ratio in the nozzle is kept high, typically in excess of 10 to 1. This ensures excellent atomization and an adequate supply of entrained hot combustion gas to promote pre-vaporization of the atomized fuel.

At high fire conditions, the air-to-fuel ratio in the nozzle is low, approximately 1.5 to 1, depending upon the supply pressure. Nevertheless, under these conditions, the combustion gas recirculation rate will be quite adequate to effect pre-vaporization of the atomized fuel, for the increase in fuel mass flow rate will then enhance the ejector action of the atomizer nozzle.

Improved diffused performance is also ensured by the present arrangement; for passage velocities are low, and as recirculation is induced at the exit plane, flow stability is increased.

First Burner Modification

Figure 2:
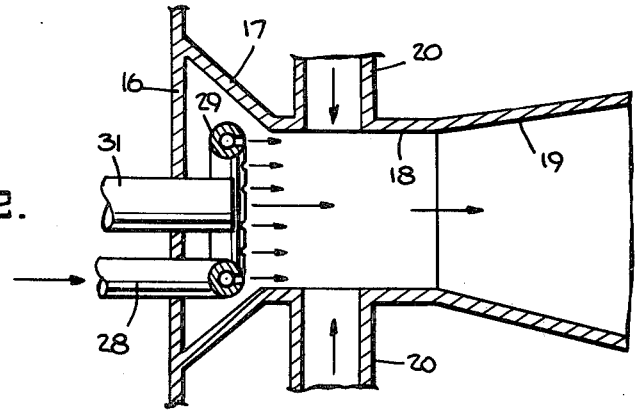
FIG. 2 is a first modification of the basic burner.

In some instances, it may be desirable to make use of a gaseous as well as a liquid hydrocarbon fuel. The burner in accordance with the invention may be given a gaseous fuel capability by the modification of the basic structure shown in FIG. 2. In this arrangement, gaseous fuel is fed through input pipe 28 to a manifold ring 29 having a circular array of jet openings 30 to feed the gaseous fuel into the Venturi throat section 18 to intermingle with the air-atomized liquid fuel emitted by a nozzle 31 coaxially disposed within ring 29.

The intermingled gaseous fuel and air-atomized liquid fuel mixture then passes through the Venturi into the combustion zone, from which a portion of the hot gas is recirculated in the manner previously described to pre-vaporize the air-atomized liquid fuel. Since pre-vaporization of the gaseous fuel in the FIG. 2 arrangement is not required, the level of hot gas recirculation and entrainment may be reduced in accordance with the ejector principles described in connection with FIG. 1. In practice, one may operate this embodiment with gas alone.

Second Burner Modification

As pointed out previously, the rate of entrainment in the mixing zone within throat section 18 of the Venturi depends on several factors including the axial position of the nozzle relative to the throat section. In the FIG. 3 arrangement, nozzle 32, which is centrally mounted on rear wall 16 of the outer casing is made axially shiftable with respect to throat section 18, so that the nozzle may be brought toward or away from the throat section, making it possible to modulate the combustion gas recirculation rate.

Figure 3:
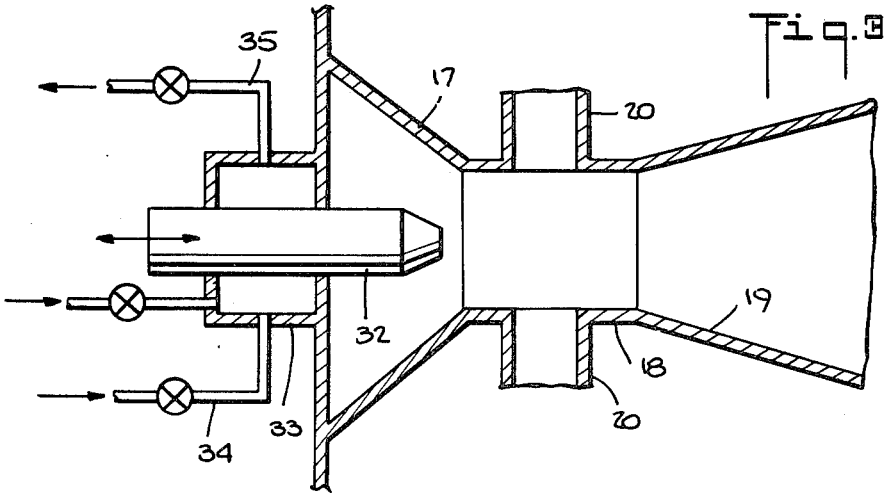
FIG. 3 is a second modification of the basic burner.

In the FIG. 3 arrangement, nozzle 32 is supplied with liquid fuel and atomizing air by a distributor 33 within which it is slidably mounted. Liquid fuel is supplied to distributor 33 through a fuel supply control line 34, and liquid fuel is returned to the supply through a spill line 35. Atomizing air is supplied to distributor 33 through an air supply control line 36. Thus with this modified arrangement, one may axially adjust the position of nozzle 32 relative to the Venturi to vary the mass flow rate of the recirculated hot combustion gas.

Third Burner Modification

In the arrangement shown in FIG. 4, the air-atomized liquid fuel is fed into a combustion zone 37 through a multiple bank of Venturi modules, only two of which (modules 38 and 39) are shown within the rear section of the outer casing. Each Venturi module is essentially the same as the Venturi structure illustrated in FIG. 1 and includes the necessary feedback ducts through which hot combustion gas from the combustion zone is fed into the constricted throat section to pre-vaporize the air-atomized liquid fuel in the manner previously described.

This multiple Venturi arrangement and modular design enlarges the capacity of the burner. In this arrangement, the Venturi modules are arranged about a central hub 40 which projects into combustion zone 37 and is provided with circumferential openings to admit combustion air into this zone. Thus the combustion air enters the combustion zone, not only through air admission chamber 14 between inner and outer casings 10 and 11, but through central hub 40 as well. The advantage of this arrangement is that pre-vaporized liquid fuel emitted from the diffuser sections of the several Venturi modules is intercepted in the combustion zone by combustion air coming from all directions rather than only from the surrounding air admission chamber 14.

With this multiple arrangement of Venturi modules and atomized fuel injection points, one can intermittently operate selected fuel injectors, using a common combustion air supply.

Fourth Burner Modification

In the arrangement shown in FIGS. 1 to 4, feedback ducts 20 supply the hot combustion gas to throat section 18 of the Venturi directly through openings in this section. A more efficient feedback arrangement is shown in FIG. 5 wherein throat section 18 is surrounded by an annular shell 41 to define a common manifold therefor, to which the outputs of all feedback ducts 20 are coupled. Throat section 18 has a circumferential array of holes 42 therein to admit the hot combustion gas in the manifold derived from all of the feedback ducts.

Fifth Burner Modification

In the arrangements shown in FIGS. 1 to 5, all of the recirculated hot combustion gas is fed into throat section 18 of the Venturi. To enhance recirculation and to improve the performance of diffuser section 19 of the Venturi, FIG. 6 shows a modified arrangement in which there is axial staging of the recirculation feedback passages.

This is effected by a primary feedback duct 20 which directs hot combustion gas to throat section 18 to pre-vaporize the atomized liquid projected therethrough, and a secondary feedback duct 20' which directs hot combustion gas into the diffuser section 19 of the Venturi, thereby ensuring complete gasification of the fuel before the fuel is admitted into the combustion zone at the diffuser exit plane 19A.

Sixth Burner Modification

In the arrangement illustrated in FIG. 1, the relatively cold combustion air is brought in through inlet pipe 26 coupled to the rear section of outer casing 10 of the burner. In some instances, it may be desirable to intermingle this cold combustion air with warm gas taken from the discharge flue externally coupled to the burner.

To this end, as shown in FIG. 7, air pipe 26 is provided at its junction with outer casing 10 with a Venturi passage 43, and flue gas is admitted into this Venturi through a control valve 44 in an inlet pipe 45. Thus the Venturi passage in air pipe 26 serves to induce the flue gas therein.

Seventh Burner Modification

In the basic burner arrangement shown in FIG. 1, a Venturi structure is disposed within the rear section of outer casing 10 and a plurality of feedback ducts supply hot combustion gas to the throat section of the Venturi. In the arrangement shown in FIG. 8, in lieu of several feedback ducts, the Venturi structure formed by inlet throat and outlet sections 17, 18 and 19 is fabricated of heat-resistant material. This Venturi is surrounded by a feedback chamber 46 formed by an auxiliary inner casing 47 concentrically disposed within the rear section of outer casing 10. Feedback chamber 46 communicates with combustion zone 13 by opening 48 in partition 11 which divides the outer casing.

In this modified arrangement, the space between outer casing 10 and auxiliary inner casing 47 defines an auxiliary air-admission chamber 49 which receives incoming combustion air from inlet pipe 16 and supplies this air to the main air-admission chamber 14 through openings 27 in partition 11. Auxiliary inner casing 47, which is heated by the recirculating hot combustion gas, is cooled by the flow of combustion air which carries away this heat.

Thus the structure of the blue flame burner is simplified, but in all other respects, it behaves in the same manner as the structure in FIG. 1 wherein the hot combustion gas fed back to throat 18 of the Venturi is drawn therein by the ejector action produced by emission of atomized liquid fuel from nozzle 24.

Eighth Burner Modification

The blue flame burners shown in FIGS. 1 to 8 are adapted to function over a wide operating range, such burners being especially useful as high capacity burners for industrial applications. In most commercial and domestic installations, the requirement is for a low-capacity burner operating in an ON/OFF manner under the control, for example, of a household thermostat, so that the burner either functions at its normal capacity or is turned off entirely.

In such low-capacity installations, the problems attending a turn-down operation do not come into play. FIG. 9 shows a low-capacity fuel burner in accordance with the invention which exploits a low exterior system back-pressure and utilizes the ejector action of the air-atomizing fuel nozzle 24 in the manner set forth in FIG. 1.

The air-atomized fuel is projected through a Venturi structure mounted in the rear section of outer casing 10. However, in this instance, inner casing 12 is not provided with openings to feed combustion air into combustion zone 13, nor is the required combustion air obtained from the usual secondary blower or similar means. Instead, combustion air is induced from the ambient air surrounding outer casing 10, this air passing through a suitable regulating device 50 located on the exterior of this casing.

The induced air passes into air-admission chamber 14, and from there enters through port 27 in partition 11, in the direction indicated by the arrows, a feedback chamber 51 surrounding the Venturi structure disposed in the rear section of the burner. A portion of hot combustion gas from combustion zone 13 is admitted into feedback chamber 51 through openings 52 in partition 11.

Thus admitted into feedback chamber 51 is both hot combustion gas derived from combustion zone 13 and combustion air taken from air-admission chamber 14, this air being cooled by the heat transfer characteristics of outer casing 10. This mixture of hot combustion gas and combustion air is sucked into throat section 18 of the Venturi through holes therein as a result of the injector action of nozzle 24, the air-atomized fuel being pre-vaporized by this recirculating hot gas.

Improved Air Atomizers

Referring now to FIG. 10, there is shown a liquid fuel-atomizer nozzle having internal manifolding therein to produce an air shear action on the inner core as well as on the outer periphery of the liquid fuel to be atomized before it is injected into the Venturi structure of the burner. It is to be understood that this atomizer, while it represents a preferred form of atomizer nozzle for burners in accordance with the invention, is not limited in its practical applications to burners of this type and may be used with other forms where a high degree of atomization is the desideratum.

The atomizer in accordance with the invention comprises a cylindrical housing 53 having an internally-threaded longitudinal bore. An atomizing-air coupler 54 is threadably secured to the housing and extends axially from the rear thereof. Threadably received within housing 53 and locked internally therein by a locknut 55 is a cylindrical air-distributor 56. The forward end 53A of housing 53 is externally threaded to facilitate mounting of the nozzle and the adjustment of its axial position, as, for example, on rear wall 16 of the burner shown in FIG. 1. The set position of the nozzle is fixed by a locknut 57. Projecting forwardly from the front end of housing 53 is a conical nose section 58 of reduced diameter from which the air-atomized fuel mixture is emitted.

Formed internally within housing 53 is an annular channel 59 defining a liquid fuel supply manifold which encircles air-distributor 56. This manifold supplies fuel via radial passages 60 to a longitudinally-extending central air passage 56A formed in the air-distributor. Also formed in the air-distributor is a circular array of secondary air passages 56B which surround the central air passage. The longitudinally-extending secondary air passages 56B serve to feed atomizing air into a secondary air chamber 61 defined by the space within housing 53 between the forward end of air-distributor 56 and the front end of the housing.

Liquid fuel is supplied to fuel manifold 59 via a feed assembly 62 having a lateral inlet 63 which is coupled to a fuel supply source and an axial outlet 64 to which a spill pipe is coupled to return unused fuel to the source.

In operation, liquid fuel admitted into manifold 59 and conducted through radial fuel passages 60 to the central air passage 56A in the air-distributor is atomized at the wall of this air passage due to the turbulent interaction of the incoming fuel and the forwardly rushing air.

The intermingled liquid fuel and air emerging from the exit of central air passage 56A is projected into a central mixing zone 65 formed in the conical space between the exit of this passage and sizing orifice 66 in registration therewith. The orifice passes the atomized fuel into an outwardly-tapered central bore 67 formed in nose section 58 of the housing. In mixing zone 65, the periphery of the atomized fuel stream issuing from central passage 56A is subjected to the turbulent force of air in the secondary air chamber 61 which surrounds this central stream.

Thus the outer boundary of the fuel-air mixture discharged from the exit of the central passage 56A is subjected to secondary atomizing air and is further atomized thereby, so that both internal and external atomization takes place within nozzle housing 53. The air-atomized liquid fuel which passes through sizing orifice 66 and through tapered bore 67 in nose section 58 exits from this nose section at port 68 which has a sharp edge creating a flow discontinuity that promotes turbulence and further enhances atomization.

FIG. 11 shows a simplified version of the improved atomizer nozzle which operates on essentially the same principles as that shown in FIG. 9. But instead of providing a housing which must be machined or otherwise fabricated to define a fuel manifold and a secondary air chamber, the air distributor 56' in this instance is so formed as to define an annular manifold 59' to which fuel is supplied by the liquid fuel feed assembly 62, the fuel being conducted to central air passage 56A by radial passages 60, as in the previous version of the nozzle. Secondary air chamber 61 between the air-distributor and the front end of the housing is created by undercut lugs 69.

No use is made of a locking nut, for the air-distributor is locked in place in this instance by the input air coupler 54 whose front end is brought against the rear end of the distributor. Sealing of the distributor is effected by O-rings 70 which encircle the distributor on either side of fuel manifold channel 59'.

While there have been shown and described preferred embodiments of non-contaminating blue-flame fuel burners in accordance with the invention, it will be appreciated that many changes and modifications may be made therein without, however, departing from the essential spirit thereof. For example, in the atomizer shown in FIG. 10, instead of maintaining a fixed relationship between the air distributor 60 and the nose section 58, the distance therebetween may be made adjustable in order to modulate the nozzle mass flow of the air-fuel mixture.

I claim:

1. A liquid fuel atomizer nozzle comprising:

A. a cylindrical housing having a nose section at the forward end thereof to emit air-atomized liquid fuel, said nose section having a bore provided with a converging inlet leading to a diverging outlet;

B. an air distributor disposed within said housing at a position spaced from the inlet of the nose section to define a mixing zone, said distributor having a central air passage along the longitudinal axis of the housing and at least one off-center secondary air passage, said passages leading into said mixing zone;

C. means to feed atomizing air at high velocity into the rear end of said housing for forward flow through said passages;

D. liquid fuel supply means constituted by an annular channel which encircles the distributor at an intermediate point thereon and which communicates with radial ducts extending between the channel and the central air passage to feed liquid fuel into the central passage to be intermingled with and atomized by the air flowing therethrough, atomization taking place due to the turbulent interaction of the incoming fuel and the forwardly rushing air, whereby the liquid is projected in an atomized stream into said mixing zone, the periphery of the stream in said mixing zone being subjected to the force of the air from the secondary passage to effect further atomization thereof so that both internal and external atomization takes place within the housing.

2. A nozzle as set forth in claim 1, wherein said distributor is provided with an array of secondary passages surrounding said central passage.

3. A nozzle as set forth in claim 1, further including a liquid fuel assembly laterally attached to said housing to supply the liquid fuel to the channel therein.

4. A nozzle as set forth in claim 3, further including an atomizing air coupler attached to the rear of the housing to feed air therein.

5. A nozzle as set forth in claim 1, wherein said tapered bore in said nose section terminates in a port having a sharp edge creating a flow discontinuity that promotes turbulence and further enhances atomization.

6. A nozzle as set forth in claim 1, wherein said distributor is threadably received within said housing whereby the position of said distributor relative to said nose section may be adjusted to vary the size of the mixing zone.

* * * * *